US005746612A

United States Patent [19]

Chien-Yuan

[11] Patent Number: 5,746,612

[45] Date of Patent: May 5, 1998

[54] ADAPTER JUNCTION BOX

[76] Inventor: Wang Chien-Yuan, No. 1, Lane 199, Sec. 1, Min-Chuan Rd., Tainan, Taiwan

[21] Appl. No.: 748,539

[22] Filed: Nov. 13, 1996

[51] Int. Cl.[6] ..... H01R 13/44

[52] U.S. Cl. ..... 439/139

[58] Field of Search ..... 439/139

[56] References Cited

U.S. PATENT DOCUMENTS

| | | | |
|---|---|---|---|
| 4,520,243 | 5/1985 | McIntyre | 439/139 |
| 5,096,432 | 3/1992 | Cullen et al. | 439/139 |
| 5,624,270 | 4/1997 | Blanchot et al. | 439/139 |

*Primary Examiner*—P. Austin Bradley
*Assistant Examiner*—T. C. Patel
*Attorney, Agent, or Firm*—Morton J. Rosenberg; David I. Klein; Jun Y. Lee

[57] ABSTRACT

An adapter junction box is provided that consists of an upper and a lower shell, a base strip held in a base holder of the lower shell, a spring placed in each bushing segment on the top side of the base strip. A guard plate is put on the other end of the spring by a sleeve formed on the bottom side of the guard plate, so that the V-shaped heads of the sleeve of the guard plate are opposite to V-shaped guide heads of the bushing segment on the base strip, wherein the guard plate blocks the sockets. When a plug is correctly plugged into the sockets of the adapter junction box, the guard plate is turned at an angle by sliding the V-shaped heads on the V-shaped guide head as the guard plate is moved down by the pins of the plug, so that the path of the pins is cleared and the pins of the plug can engage the conducting strips. When a foreign object is plugged into one socket, the guard plate is pressed unevenly so that the guard plate is blocked and unable to turn to expose the conducting strips.

1 Claim, 4 Drawing Sheets

ADAPTER JUNCTION BOX

BACKGROUND OF THE INVENTION

1. Field of the Invention

The present invention relates to an adapter junction box. More particularly, this invention is directed to a pinboard with a guard plate structure on each paid of sockets, where the guard plate can be open when a plug is plugged in.

2. Prior Art

In accordance with conventional adapter junction boxes currently on the market, multiple sockets are widely provided to meet the requirement of customers. However, most of those sockets are an open style design with the sockets and the conducting strip in the junction box being exposed directly to the air. This design is very dangerous, especially to children, who due to curiosity plug something into the socket and get an electric shock. Additionally, the long term exposure of the conducting strips to the air causes the strips, which are mostly made of copper, to become oxidized, and dirt falls into the socket and piles up, so that a bad conducting contact often results.

OBJECT OF THE INVENTION

For overcoming the above-mentioned shortcomings of the prior art, a main object of the present invention is to provide an adapter junction box with a guard plate structure which prevents any objects, except the electric plug, from plugging therein.

SUMMARY OF THE INVENTION

The present invention consists of a shell including upper and lower shells, a base strip held in a base holder of the lower shell, a spring placed vertically in each bushing segment on the top side of the base strip, a guard plate put on the other end of the spring with a sleeve built on the bottom side of the guard plate so that the V-shaped heads of sleeve of the guard plate are opposite to the V-shaped guide heads of the bushing segment on the base strip, in the normal state as the guard plate blocks the sockets tightly. When the plug is plugged into the sockets of the adapter junction box in the correct way, the guard plate is turned at an angle by sliding the V-shaped heads on the V-shaped guide head as the guard plate is moved down by the pressing of the pins of the plug so that the path of the plug is unblocked and the pins of the plug can contact the conducting strips. When a foreign body is plugged into one socket, the guard plate is pressed slantingly so that the V-shaped heads and the V-shaped guide heads lock together, thereby the guard plate is not able to be turned to open, as the guard door prevents the foreign body from entering.

DETAILED DESCRIPTION OF THE PREFERRED EMBODIMENTS

Figure 1:
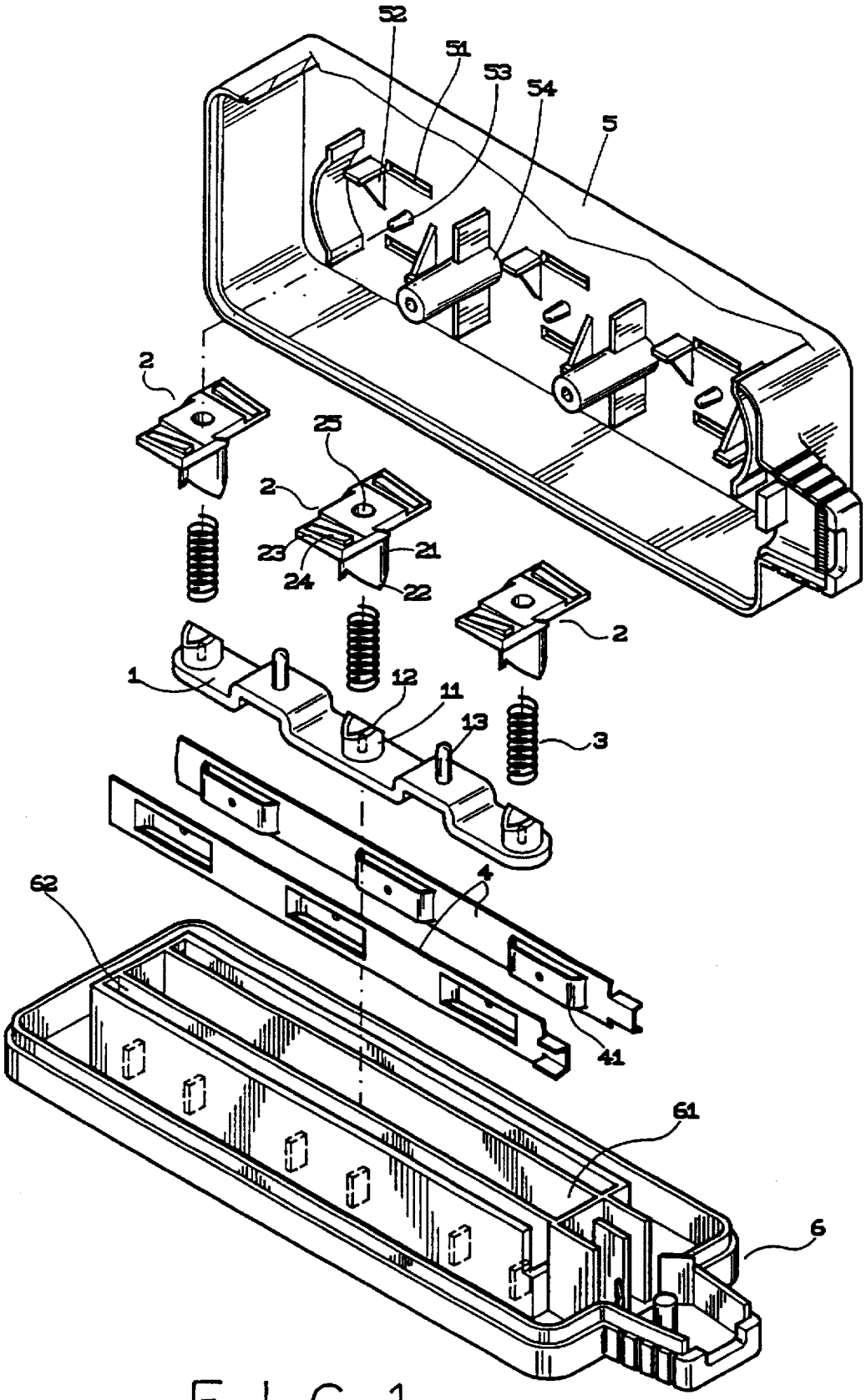
FIG. 1 is an exploded view of the present invention.

Referring to FIG. 1, the present invention includes a base strip 1, guard plates 2, springs 3, two conducting strips 4, an upper shell 5 and a lower shell 6. The base strip 1 is a square-wave-shaped strip, in which a plurality of hollow bushing 11 are formed on the lower segments at one side thereof, a V-shaped slot crosses the top of the bushing 11 to form two opposite beveled guide heads 12, and a plurality of locating pins 13 extending upwardly from each higher segment.

The guard plate 2 is a rectangular shaped strip having a hollow sleeve 21 formed at the center on a bottom side thereof. A V-shaped slot is cut across the free end of the sleeve 21 to form two opposite V-shaped heads 22, and a pair of slopes 23 are formed on the respective sides of the top surface of each guard plate, each of the pair of slopes slants towards a different direction. Two sloping ledges 24 are respectively formed on the slopes 23, and a blind hole 25 is formed in the top center portion of each guard plate 2.

The spring 3 is placed into the space surrounded with the bushing 11 of the base strip 1 and the sleeve 21 of the guard plate 2. Each conducting strip 4 is a long and thin flat piece with several raised segments 41 to provide a space for the pin 71 of the plug 7 to be inserted therein. The upper shell 5 comprises a series of rows of parallel pairs of sockets 51, a pair of triangle stoppers 52 set upon the inside surface of upper shell 5, adjacent the opposite sides of each pair of sockets 51, respectively, and a series of leading pins 53 formed in-between each pair of sockets 51, and two posts 54 disposed in-between the pairs of sockets 51. The two posts 54 each have a blind hole formed in a top end thereof for receiving the locating pins 13 of the base strip 1 therein to ensure they are properly positioned. The lower shell 6 has a rectangle shaped base strip holder 61 corresponding to that of the upper shell 5 and two locating slots 62 extending upwardly from the inner bottom surface of lower shell 6 for holding the conducting strips 4 therein.

Figure 2:
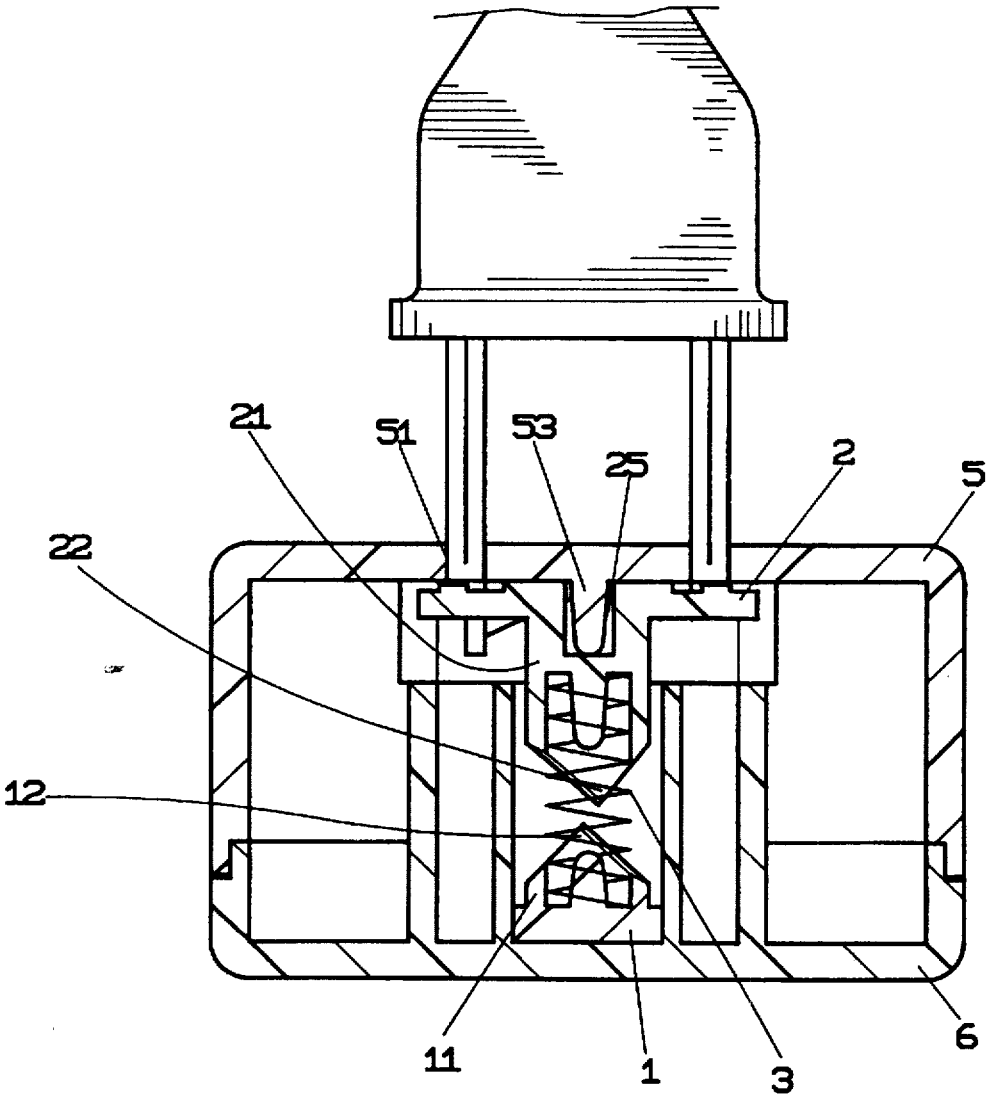
FIG. 2 is a side cross-sectional view of the present invention.

In assembling, referring additionally to FIG. 2, the base strip 1 is embedded into the base strip holder 61 on the lower shell 6 and the conducting strips 4 are placed in the two locating slots 62, respectively. Then, the bottom end of the springs 3 are inserted onto the bushings 11 of the base strip 1, respectively. Next, the sleeve 21 of the guard plates 2 are placed over the top end of the respective springs 3. Finally, the upper shell 5 covers lower shell 6 with the posts 54 being placed on the locating pins 13 of the base strip 1, so that the leading pins 53 on the upper shell 5 fit in the blind guide holes 25 on the top of the guard plates 2, respectively. Each guard plate 2 is located under a respective pair of sockets 51, between the two stoppers 52, to block the sockets 51 by the urging force of the spring 3.

Figure 3:
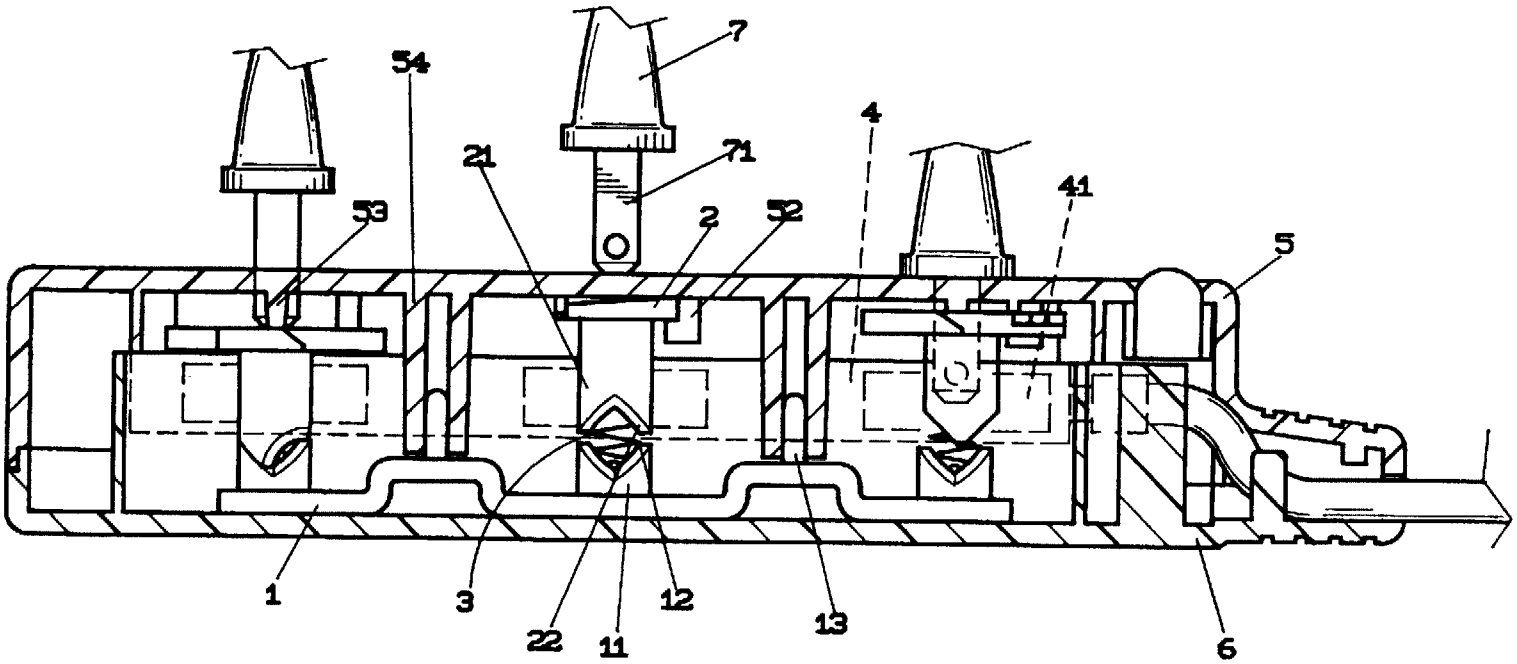
FIG. 3 is a cross-sectional view showing the actions of the present invention.

Referring additionally to FIG. 3, when a plug 7 is plugged into the sockets 51 of the upper shell 5, the two pins 71 of the plug 7 press the two sloping ledges 24 on the guard plate 2 down at the same time. Because of the slopes on the top of the sloping ledges 24, the guard plate 2 is forced to turn at an angle around the leading pin 53 to make the V-shaped heads 22 alternate an angle with the beveled guide heads 12 of the sleeve 11 on the base strip 1. When the guard plate 2 continues to move downward, the V-shaped heads 22 touch against and slide on the surface of the beveled guide heads 12 in different directions, so that the guard plate 2 turns to a 90 degrees angle as the V-shaped heads 22 and the beveled guide heads 12 mesh together to provide a path for the pins 71 of the plug 7. Hence, the plugging pins 71 can move down continuously and engage with the conducting strips 4, the pins 71 being inserted into the intervals of the raised segments 41, completely. When the plug 7 is unplugged from the socket of the present invention, the spring 3 urges the guard plate 2 upward, cooperating with the slopes 23 on the guard plate 2 and the angled side on the triangle stoppers 52, so that the guard plate 2 can be turned back to restore their original state.

Figure 4:
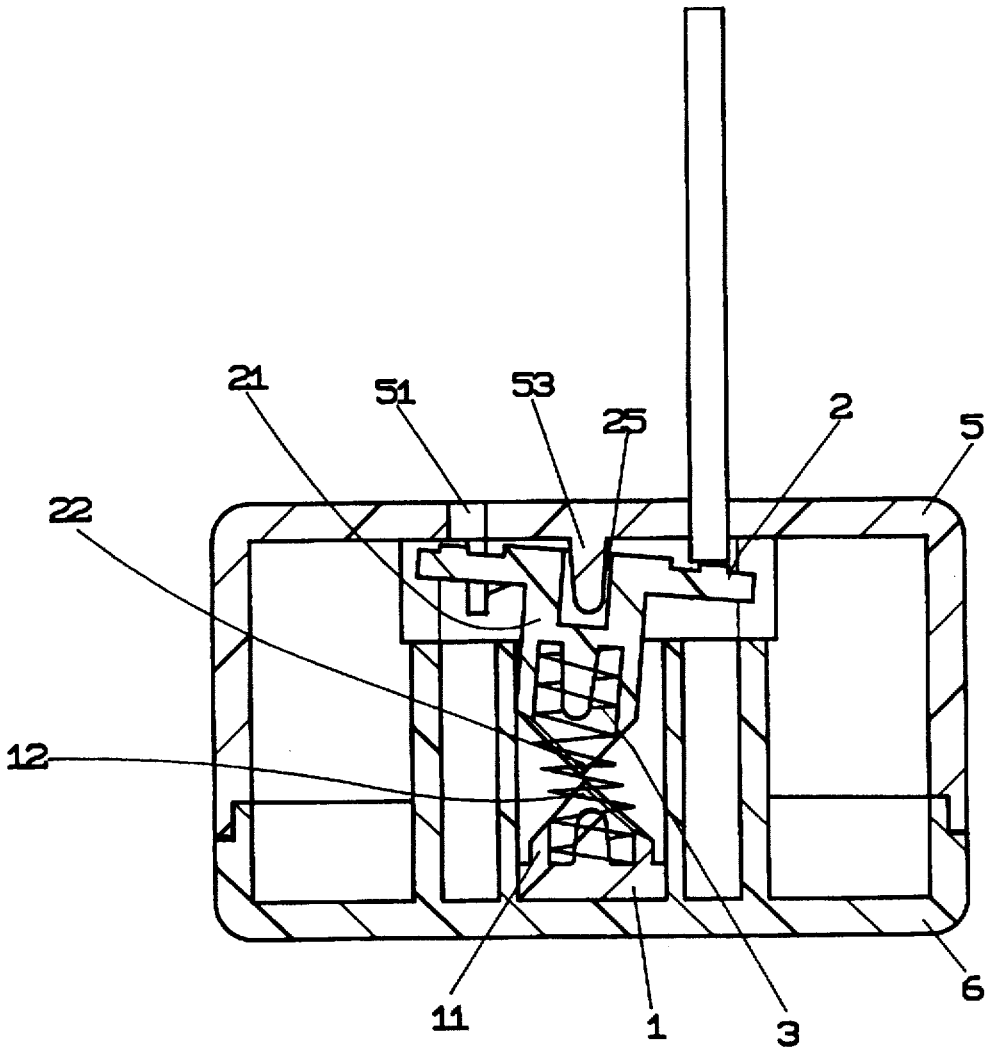
FIG. 4 is a cross-sectional view showing the actions of the present invention.

If a foreign object is inserted into the socket 51, as shown in FIG. 4, the guard plate 2 receives an unbalancing force to tilt and touch against the side wall of the base strip holder 61, so that the guard plate 2 blocks the sockets 51.

I claim:

1. An adapter junction box, comprising:

a lower shell having a pair of spaced locating slots formed therein and a base strip holder formed therebetween;

a pair of conducting strips respectively retained in said pair of locating slots;

a base strip disposed in said base strip holder and having a plurality of hollow bushings extending from an upper surface of said base strip, each of said plurality of hollow bushings having a V-shaped slot formed in an upper end thereof to define a pair of beveled guide heads;

a plurality of springs, each of said plurality of springs having a first end coupled to a respective one of said plurality of hollow bushings;

a plurality of guard plates, each of said plurality of guard plates having opposing upper and lower surfaces, each of said plurality of guard plates having a hollow sleeve extending from a central portion of said lower of said guard plate, each said hollow sleeve being coupled to a second end of a respective one of said plurality of springs and having a V-shaped slot formed in a distal end thereof to define a pair of V-shaped heads, each of said plurality of guard plates having a pair of slopes formed on said upper surface of said guard plate and a pair of sloping ledges respectively formed on said pair of slopes; and, an upper shell overlaying said lower shell and secured thereto, said upper shell having a plurality of pairs of openings for receiving prongs of an electrical plug therein, each of said pair of openings being located in aligned relationship with said pair of sloping ledges of a respective one of said plurality of guard plates for initiating a rotative displacement of said guard plate as the prongs of the electrical plug are inserted into said respective pair of openings for angling said V-shaped heads relative to said beveled guide heads, wherein subsequent contact between said V-shaped heads and said beveled guide heads rotates said respective guide plate to provide a path for the prongs of the electrical plug contact said pair of conducting strips.

* * * * *